US006575613B2

(12) United States Patent
Brown et al.

(10) Patent No.: US 6,575,613 B2
(45) Date of Patent: Jun. 10, 2003

(54) PORTABLE SPECIAL EFFECTS ILLUMINATION DEVICE

(75) Inventors: Barry P. Brown, Denver, CO (US); Michael D. Hennessey, Denver, CO (US)

(73) Assignee: Pumpkin Ltd., Denver, CO (US)

( * ) Notice: Subject to any disclaimer, the term of this patent is extended or adjusted under 35 U.S.C. 154(b) by 0 days.

(21) Appl. No.: 09/971,786

(22) Filed: Oct. 4, 2001

(65) Prior Publication Data

US 2003/0067790 A1 Apr. 10, 2003

(51) Int. Cl.[7] ..... A47G 35/00; A63J 17/00; F21S 4/00; F21V 7/04

(52) U.S. Cl. ..... 362/565; 362/806; 362/810; 362/186; 362/241; 362/441; 362/240; 362/362

(58) Field of Search ..... 362/806, 810, 362/565, 186, 559, 124, 363, 234, 235, 236, 237, 241, 244, 245, 247, 311, 441, 240, 375, 276, 362

(56) References Cited

U.S. PATENT DOCUMENTS 1,013,947 A * 1/1912 Neil ..... 362/498
4,858,079 A * 8/1989 Ohashi ..... 362/35
4,955,807 A * 9/1990 Chance et al. ..... 431/296
5,091,833 A * 2/1992 Paniaguas et al. ..... 362/191
5,613,764 A 3/1997 O'Brien
5,918,964 A 7/1999 Bou
6,000,820 A 12/1999 Murray
6,290,381 B1 * 9/2001 Mangum et al. ..... 362/554
6,293,510 B1 * 9/2001 Bradford et al. ..... 248/317
6,309,092 B1 * 10/2001 Bardeen et al. ..... 362/392

FOREIGN PATENT DOCUMENTS

DE 3835015 A1 * 4/1990 ..... F21S/1/02

* cited by examiner

*Primary Examiner*—Sandra O'Shea
*Assistant Examiner*—Sharon Payne
(74) *Attorney, Agent, or Firm*—Timothy J. Martin; Michael R. Henson; Rebecca A. Gegick

(57) ABSTRACT

An illumination device especially adapted for internally illuminating a decorative object wherein the decorative object is associated with a particular seasonal holiday, festive, or celebratory event. The device includes a dome shaped housing that is sized and configured to mount inside the decorative object. The housing has concavities with reflective surfaces and electric lights that are disposed in the concavities. Electric current is supplied to the light for illumination of the interior of the decorative object. The illuminative object has the optional capability to flash the electric lights to mimic the flickering of a burning candle and employ the use of fiber optics for special lighting effects.

26 Claims, 6 Drawing Sheets

PORTABLE SPECIAL EFFECTS ILLUMINATION DEVICE

FIELD OF INVENTION

The present invention generally relates to illumination devices that produce special lighting effects. More particularly, the present invention is directed to illumination devices adapted for use to internally illuminate decorative objects related to specific holiday, seasonal, festive, or celebratory events, for example, a device to illuminate the interior of a carved pumpkin or jack o'lantern at Halloween.

BACKGROUND OF THE INVENTION

It is a common desire among many people to be able to decorate their house for a particular seasonal, holiday, festive or other celebratory event in attempting to achieve a maximum visual impact with a minimum burden of cost and effort. In particular, the holiday of Halloween has become very popular world wide in recent years and Halloween has a focus on upon having ghoulish, shocking, or scary visual effects as one of this holiday's major attributes. In accomplishing these shocking visual effects, many things are done, such as placing carved pumpkins, or jack o'lanterns, hanging Halloween figurines, ghosts, goblins, witches, monsters, posters, shades, etc. in windows. Other visual effects include spraying a spider web material on the inside of the window, or creating a three dimensional scene in the room that is inside of the window.

Usually included, in such decorations is some sort of special lighting or illumination effect as the impact of the visual image is especially predominant at nighttime. Many ways are used to provide unique lighting such as a candle or light inside the carved pumpkin, spot or colored lights in windows, special candle enclosures along sidewalks, window ledges, etc. Candles give an especially desirable effect with their warm orange glow, and flickering light that adds to the mysterious allure of the illuminated carved pumpkin at night. However, candles have a number of drawbacks concerning mounting stability, wind extinguishments, short burn time, fumes, and fire safety.

Typically short slender candles or votive candles are used and are usually just placed in the bottom of the pumpkin without being secured in any manner to the pumpkin shell. Sometimes aluminum foil or aluminum pie pans or pins are used to set the candle in or placing the candle in a puddle of softened wax can be used also. None of the methods hold the candle securely, allowing the candle to tip over and be extinguished, or fall out of the pumpkin. Also, none of these methods contain the wax of the votive candle; therefore the burning time of the votive candle is reduced. As the candle burns in the pumpkin it is necessary to provide a chimney or flue so that smoke and heat can escape from the pumpkin interior. This flue or chimney must be carved in the top of the pumpkin shell and besides being unsightly, the presence of the pumpkin stem and correspondingly thick shell rind near the stem area makes adding the flue or chimney difficult. In addition, if the flue or chimney is too small or non existent an offensive odor can result from burnt pumpkin rind.

The industry has responded in addressing some of these problems associated with candles by providing better candle mounts in the pumpkin in the form of a wire holder. This holder has a first segment that wraps around the candle outside diameter with remainder of the wire inserted into the pumpkin shell rind. This helps overcome the problem of candle stability, but does not address the other drawbacks of candles, namely, wind extinguishments, short burn time, fumes, and fire safety.

The industry has also developed a number of battery-powered lights that attempt to mimic the effect of a candle burning inside of a carved pumpkin. The most basic battery powered light is nothing more than a small flashlight that is placed vertically in the bottom of the pumpkin with the clear lens light bulb exposed, wherein the light bulb illuminates steadily. Other devices are somewhat more advanced with the light bulb having a flat reflector to broaden the light diffusion. Also, circuitry has been added to make the light bulb flashing, which can more closely simulate a candle flickering. One particular scenario is to use one light bulb and have a sequence of different time periods for the light to be illuminated, such as two short light illumination periods followed by a longer duration light illumination period to more closely simulate the effect of a candle flickering. Another method of accomplishing the candle flickering effect is to use a plurality of lights, wherein each light flashes independently at different times giving the image of different light illumination periods. Other devices combine continuous or flashing battery powered lights light with audible sounds that reflect the holiday or festive event, such as laughing monsters for Halloween. Finally, a plurality of lights can be of different colors to produce a softer light than using a clear lens light bulb, with the clear lens producing a bright light compared to the soft glow of a burning candle.

Despite these past developments, there remains a need in the industry for an effective device to illuminate carved pumpkins or jack o'lanterns that is inexpensive, easy to use, enhances safety, and gives an image closely resembling a burning candle. The device should also be self-contained and not require any additional items or parts to use other than normal household items. The present invention satisfies these desires while providing the desired visual image.

SUMMARY OF THE INVENTION

It is an object of the present invention to provide a new and useful illumination device for placement inside of a decorative object that has an opening sized and configured to display a selected decorative feature when the interior is illuminated.

A further object of the present invention is to provide an illumination device that is relatively inexpensive to produce and is lightweight, compact, safe, and self-contained to be easily portable.

Another object of the present invention is to provide illuminative effects that enhance the visual experience of an individual observing a decorative object for a festive or holiday event.

A further object of the present invention is to mimic the desirable illuminative effects of a candle burning with a flickering light.

Still a further object of the present invention is to overcome the traditional drawbacks of using a candle for decorative object illumination such as fire risk, heat, smoke fumes, short burn life, and wind extinguishments, by the use of an electric light.

Another object of the present invention is to provide a much greater level of mounting stability of the illuminative device in the decorative object as compared to traditional items such as candles.

Yet another object of the present invention is to provide for various light diffusing and light coloring effects to enhance the visual impression of the of the illuminated decorative object on the observer.

Still yet another object of the present invention is to provide special lighting effects for the illumination of the decorative object such as the use of translucent decorative inserts and fiber optics.

As yet another object of the present invention is to be able to mount the device in a number of different decorative objects.

Another object of the present invention is to provide unique auditory sound effects to further enhance the decorative objects effect for a festive event.

To accomplish these objects, the present invention, then, is directed to an illumination device for providing visual effects from the openings of a decorative object to enhance the observation of an individual of the decorative object for a particular festive or holiday event. The illumination device is adapted to rest on a generally flat support surface and to have a source of electrical power provided either internally or externally. The illumination device preferably consists of a housing that includes a bottom portion that is adapted to contact the support surface and has an upper portion that is a dome shaped exterior surface. The dome shaped exterior surface has a concavity formed in it that has an optically reflective concave surface. The housing may have attachment protrusions extending downward from the bottom portion to secure the housing to a support surface that can enhance the mounting stability of the illumination device.

An electrical lighting element is disposed in the optically reflective concavity and is connectable to the source of electrical power to emit light. The electrical lighting element is positioned such that the light emitting therefrom is projected from the optically reflective concavity when the lighting element is connected to the source of electrical power. The illumination device preferably can alternate its lights in an on and off state to mimic the flickering effect of a candle and have the capability for special lenses to diffuse and color the light emitted to further provide the effect of the orange glow of a candle. Other attachments disposed on the light-emitting element such as fiber optics and translucent decorative covers in the openings of decorative objects can provide alternative lighting effects. In, addition an auditory sound generating element disposed within the housing can be combined with the lighting effects to further enhance the sensory effect on an individual for the particular festive event or holiday. The electrical power is preferably supplied by batteries disposed within the housing. Alternative electrical power can be supplied by an external source outside of the housing providing the same power as the internal batteries.

The illuminative device is used with a decorative object to form a decorative system with the decorative object having at least one opening, with the opening sized and configured to display a selected decorative feature when the interior is illuminated. The decorative object is preferably a pumpkin, however any decorative object would be acceptable that has an interior with at least one opening and can benefit from the special illuminative effects for commemorating a festive event or holiday.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENT

The present invention relates to illumination devices that are adapted to be placed within a decorative object. The present invention especially relates to decorative objects associated with a festive event or holiday that have an interior with an opening configured to display a decorative feature when the interior is illuminated. More particularly, this invention is directed to an illumination device that is relatively inexpensive to produce, lightweight, compact, and self-contained for easy portability. In the preferred embodiment, the illumination device utilizes a dome shaped housing with a reflective concavity formed in the housing surface including a lighting element that projects light from the concavity when the lighting element is connected to a source of power. While the invention is described with respect to its use with a decorative item, it should be appreciated that the illumination device may also be employed as a stand-alone light.

Figure 1:
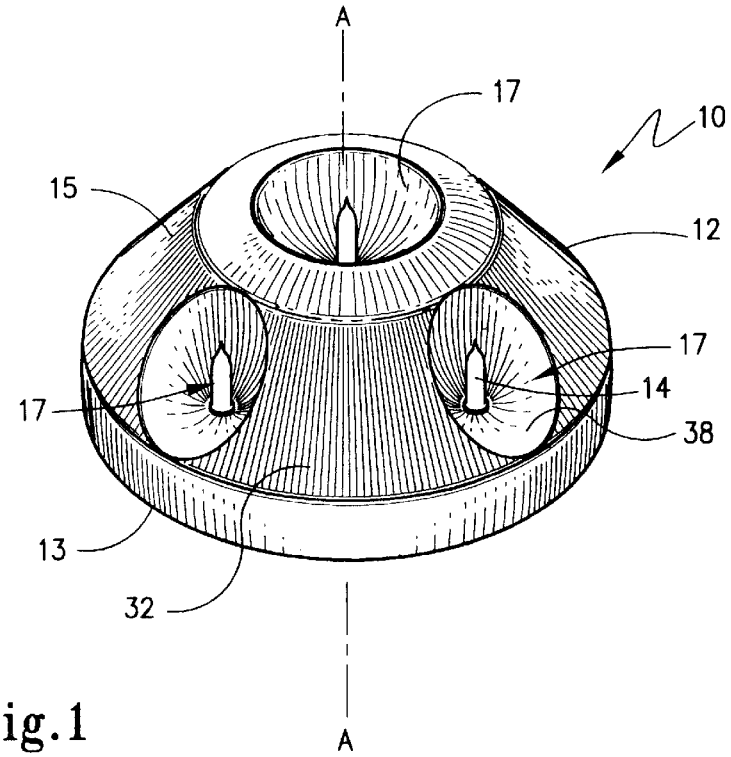
FIG. 1 is a perspective view of the illumination device according to a first exemplary embodiment of the present invention.

With reference to FIG. 1, a perspective view of the illumination device 10 is shown. Illumination device 10 includes a housing 12 that has a lower portion 13 and an upper portion 15. The lower portion 13 is adapted to rest on a generally flat support surface and the upper portion 15 is configured as a dome shape. The dome shape is created by having an upper surface formed along a geometrical surface of revolution about central axis "A—A" which defines the exterior surface configuration of the upper portion 15 of the housing 12.

At least one concavity 17 is formed in the upper portion 15 on the exterior surface of the housing 12 and has an optically reflective concave surface 38. The reflective exterior surface 38 can reside only in the concavity 17 or optionally the reflective surface 32 can cover the remaining entire exterior surface of the housing 12. In this embodiment, five concavities 17 are formed in the upper portion 15 on the exterior surface of the housing 12 to enhance the special illuminative effects. Here, one concavity is centrally located on the axis A—A with four other concavities being equiangularly spaced (at ninety degrees) around axis A—A. However, one or more concavities 17 would be acceptable on the housing 12, dependent upon the illuminative effects desired.

An electrical lighting element 14 is disposed in each concavity 17 and is connectable to a source of electrical power for the lighting element 14 to emit light. The position of the lighting element 14 in the respective concavity 17 is such that the light emitting from the lighting element 14 is projected from the concavity 17 when the lighting element 14 is connected to a source of electrical power. The lighting element 14 is any suitable electric bulb, and it may be of the type that constantly emits light, or, in the alternative, of the type that pulses on and off or "flickers" to give the effect of a candle's flicker, or of any other suitable type known in the electric bulb or LED art.

Figure 2:
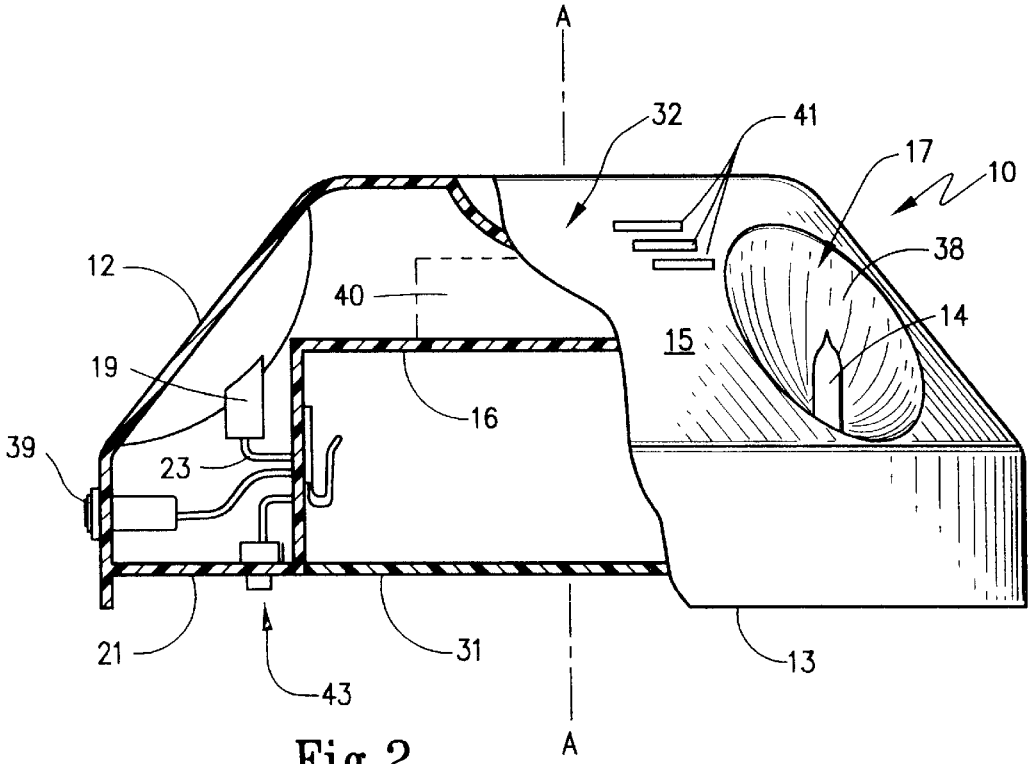
FIG. 2 is a side view in elevation, partially cut-away, of the illumination device of FIG. 1.
Figure 3:
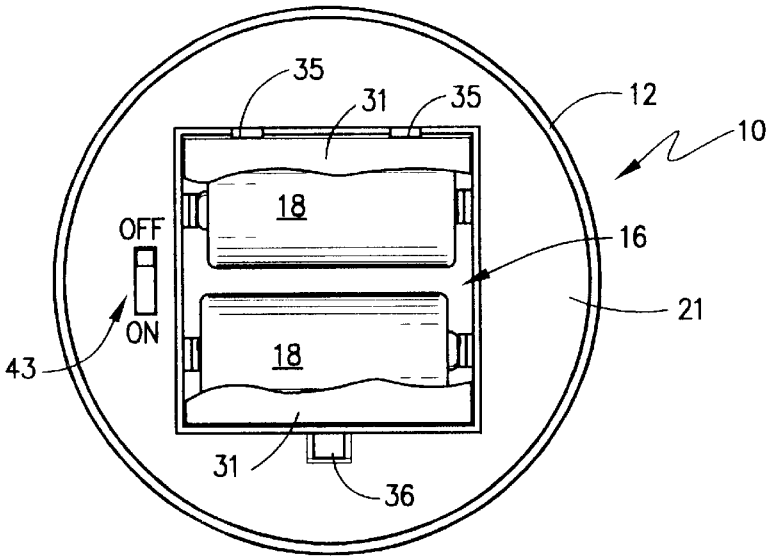
FIG. 3 is a bottom plan view, partially cut-away, of the illumination device of FIG. 1.

Turning to FIGS. 2 and 3, it may be seen that a means for supplying electrical power in the preferred embodiment is accomplished by the use of two "C" size batteries 18 connected in series and housed in a battery holder 16. Battery compartment or holder 16 is disposed within housing 12 and supported by support plate 21 that is disc-shaped and mounted inside of the housing 12. The battery holder 16 has an access door 31 that allows replacement of the two "C" sized batteries 18 from the bottom portion 13 of the housing 12. The access door 31 opens from the bottom portion 13 of the housing 12 and has insertion tabs 35 on one edge and a snap closure 36 on the opposite edge as is a common structure for battery compartments.

As an option, alternative means of supplying electrical power could be, as is known in the art, an external source of electrical power, from outside of the housing 12 using an external port 39 disposed on the exterior surface of the housing 12. The port 39 would be adapted to receive an external source of electrical power, the ordinary skilled artisan would appreciate that the use of a self contained external D.C. power source such as batteries or an appropriate A.C. to D.C. electrical adapter that can utilize standard house line electrical power could be used. An optional toggle switch 43 for turning the electrical power on and off could also be used if desired.

Each concavity 17 has a lighting element 14 with a socket holder 19 that projects toward the inside of the housing 12. The socket holder 19 supports the lighting element 14 and provides a connection point for the wires 23 that interconnect the lighting element 14 with the source of electric power. If a plurality of lighting elements 14 are desired, wires 23 are connected in a parallel arrangement with the source of electrical power. Also, in having a plurality of lighting elements 14, each lighting element 14 is positioned within one concavity 17 formed on the exterior surface in the upper portion 15 of the housing 12. Each concavity 17 has an optically reflective concave surface 38 and a socket holder 19 that is interconnected by wires 23 in a parallel manner to the means for electrical power.

An optional auditory sound-generating element 40, as is known in the art, can be disposed within the housing 12 to generate sounds through housing 12 slot openings 41. The sound-generating element 40 can generate sounds appropriate for the particular festive event or holiday and can share the same means for electrical power as the lighting element 14.

The housing 12 is preferably constructed of molded of injected plastic having sufficient strength to support the lighting elements 14, battery holder 16 with batteries 18, and other identified optional accessories. However, alternative housing 12 construction would be acceptable such as assembling plastic parts with plastic cement, metal stamping, metal turning, casting, or forming any suitable material. The reflective surface 38 and optionally, the entire reflective surface 32, can be a surface plating or coating, but could be homogeneous with the housing 12 material, or applied to the exterior surface of the housing 12 by painting, polishing, dipping, and the like.

Figure 4:
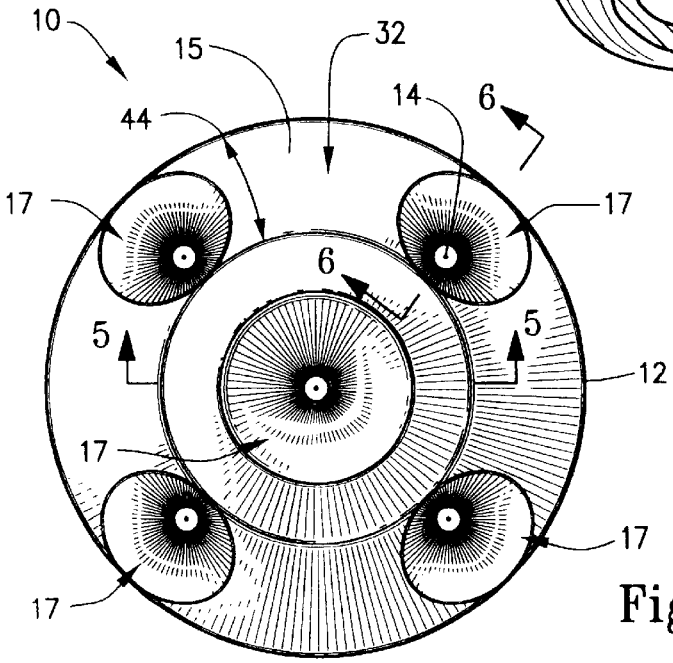
FIG. 4 is a top plan view of the illumination device of FIG. 1.

Looking to FIG. 4 a top view is shown of the illumination device 10 depicting this embodiment with five concavities 17. The concavities 17 are positioned to provide a higher illumination effect in all directions from the upper portion 15 of the housing 12. One concavity 17 is located on a central axis "A—A" in FIG. 1, to the geometrical surface of revolution of the dome shaped upper portion 15 of the housing 12. The other four concavities 17 are equiangularly spaced circumferentially about central axis "A—A" in FIG. 1, on the exterior surface of the frustoconical section 44 of the upper portion 15 of the housing 12. Each concavity 17 has a lighting element 14 positioned within the concavity 17 to optimize the light emitted from each lighting element 14.

Figure 5:
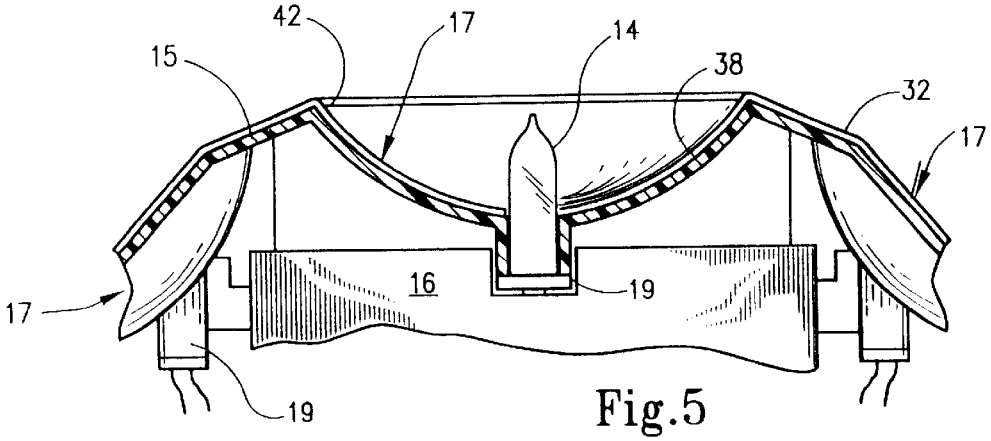
FIG. 5 is a cross sectional view taken about lines 5—5 of FIG. 4.
Figure 6:
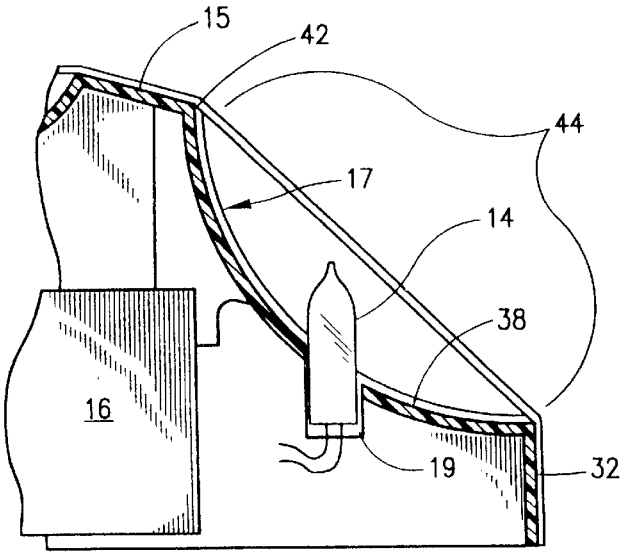
FIG. 6 is a cross sectional view taken about lines 6—6 of FIG. 4.

FIGS. 5 and 6 are sections 5—5 and 6—6, respectively, from FIG. 3, and show a section through the concavity 17 with the lighting element 14 in positioned within the concavity 17. FIG. 5 shows the concavity 17 and lighting element 14 in combination for the concavity 17 located on a central axis "A—A" in FIG. 1. FIG. 6 shows the concavity 17 and lighting element 14 in combination for the concavity 17 that is located by being equiangularly spaced circumferentially about a central axis "A—A" in FIG. 1, on the exterior surface of the frustoconical section 44 of the upper portion 15 of the housing 12. The concavity 17 profile is preferably defined by a rotated parabola, with the parabola rotated about the centerline of lighting element 14 and terminating in an edge 42 at the exterior surface of the upper portion 15 of the housing 12. The lighting element 14 is positioned within an interior region defined by the rotated parabola and a plane containing the edge 42. The optically reflective surface 38 is shown as a surface coating in the concavity 17. The concavity 17 has a parabolic shape that aids in lessening the distance between the lighting element 14 and the concavity 17 surface. This allows the lighting element 14 to not extend beyond the exterior surface of the upper portion 15 of the housing 12 and to increase the light emitted from the lighting element 14. Alternatively, the concavity 17 can be defined by another form of rotated arcuate profile, such as circular, conic, and the like.

Figure 7:
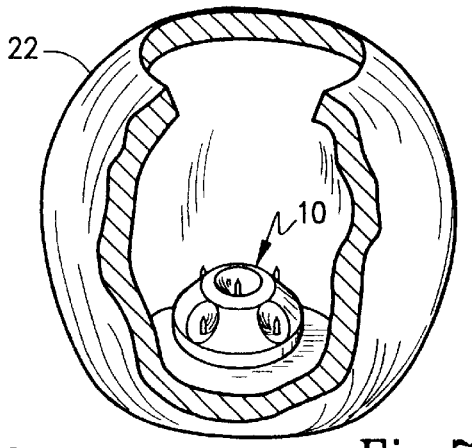
FIG. 7 is a perspective view of the illumination device in use placed inside of a decorative object that is partially cut-away.

FIG. 7 shows the illumination device 10 in use, being placed inside of a decorative or festive object 22 to form a decorative system providing illuminative effects from the decorative object 22 to commemorate a festive event or holiday. The illumination device 10 is sized and adapted to internally illuminate a decorative object 22. The decorative object 22 is preferably a carved pumpkin or Jack O'Lantern, however, the decorative object 22 could any type of a hard or soft shell structure that has a bottom wall and an upwardly extending surrounding sidewall forming an interior and that the object 22 has at least one opening or aperture formed through the sidewall. The opening in the decorative object 22 is sized and configured to display a selected decorative feature when the interior of the decorative object is illuminated.

Figure 8:
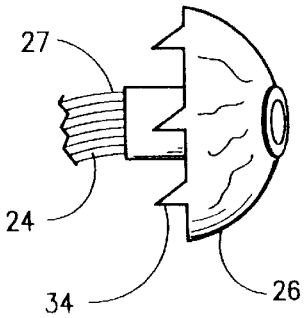
FIG. 8 is a perspective view of the ornamental insert piece.

FIG. 8 shows a detail of the ornamental insert piece 26 attached to the distal end 27 of the fiber optic 24. Attachment protrusions 34 secure the ornamental insert piece to the exterior of the decorative object. The ornamental insert piece 26 can utilize the fiber optic 24 for lighting effects or alternatively can use the ambient interior illumination of the decorative object for lighting effects with out the use of the fiber optic 24. The ornamental insert piece 26 can be made from any colored combination of translucent, opaque, or transparent materials to achieve the unique lighting effects desired. Typical materials would be plastic, glass, paper, and the like.

Figure 9:
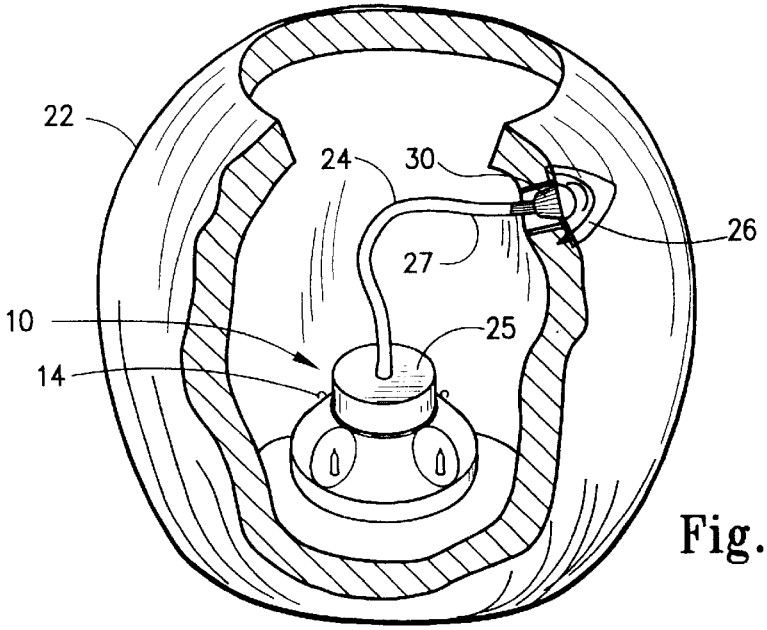
FIG. 9 is a perspective view of the illumination device with an optional fiber optic attachment in use terminating in an opening in the decorative object.

FIG. 9 is similar to FIG. 7 except for the optional addition of a fiber optic light transmission element 24 that has a proximal portion 25 and a distal portion 27. The proximal portion 25 on the fiber optic 24 is disposed near or proximately to the lighting element 14 of the illumination device 10. An ornamental insert piece 26 can be attached to the opening 30 in the decorative object 22 for additional illumination effects of different lighting colors or light diffusion, and the like. The ornamental insert piece 26 can be used with or without the fiber optic 24 as desired.

Figure 10:
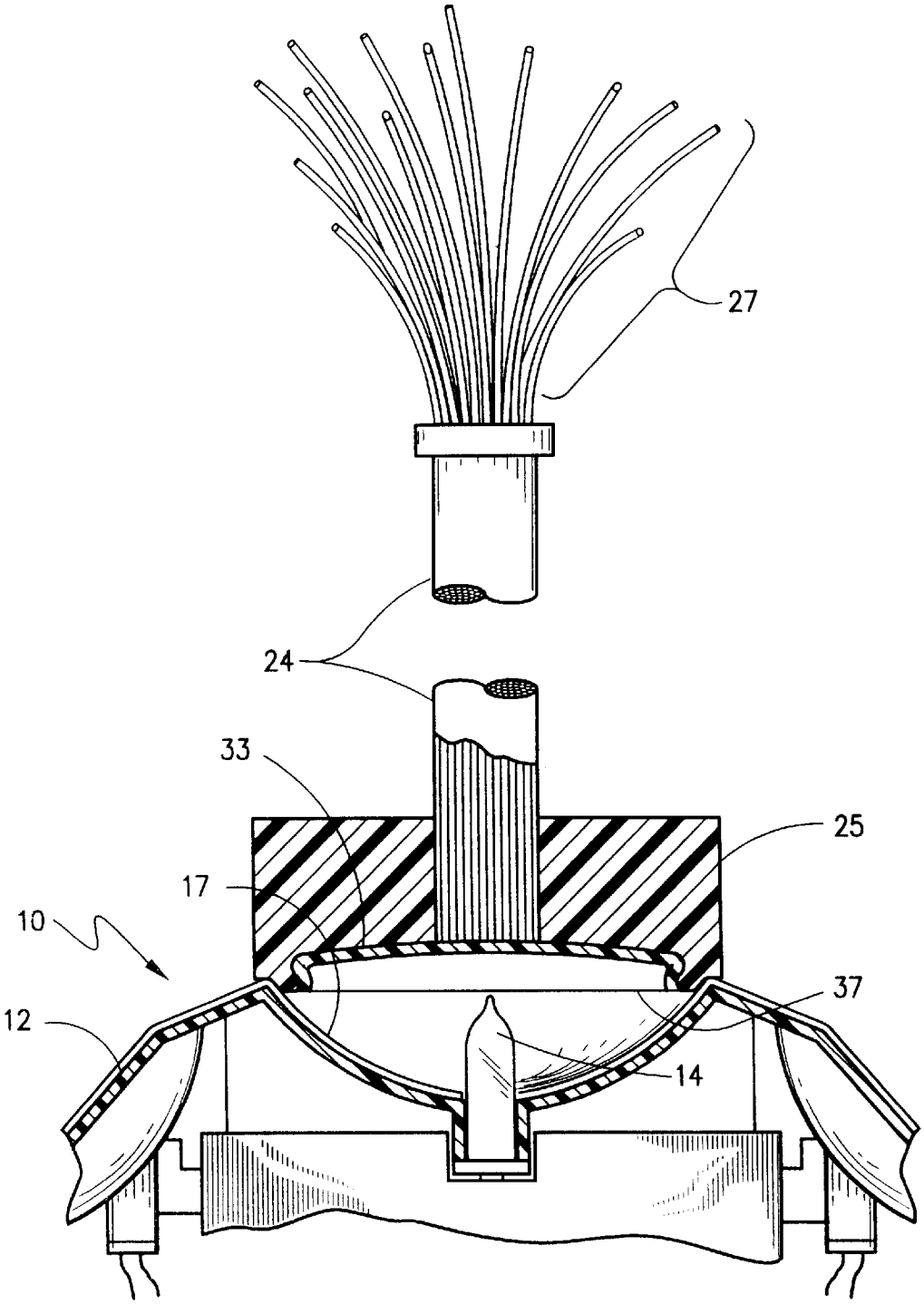
FIG. 10 is a side view in elevation of the optional fiber optic assembly attached to the illumination device.

FIG. 10 shows a detail of the fiber optic assembly 24. The fiber optic light transmission element 24 has a proximal portion 25 and a distal portion 27. The proximal portion 25 on the fiber optic 24 is disposed near or proximately to the lighting element 14 of the illumination device 10. An optional small lens cover 33 sized and configured for a single concavity 17 is disposed on the housing 12 and can also be used with the proximal portion of the fiber optic 24 to adjust the lighting color, lighting diffusion, or lighting intensity as desired for a specific lighting effect. The small lens cover 33 is secured to the proximal portion 25 of the fiber optic 24 by the retention edge 37. The distal portion 27 of the fiber optic 24 can be left as loose ends as shown or specific ends can be inserted into various opening of the decorative object, or used with the ornamental insert piece as shown in FIG. 8 or 9. The fiber optic can be constructed of any transparent and internally reflective flexible glass or plastic material that transmits light, as known in the art.

Figure 11:
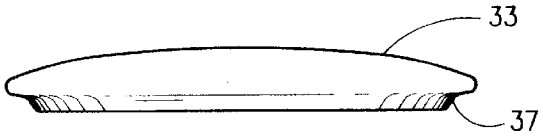
FIG. 11 is a side view in elevation of the small lens cover.
Figure 12:
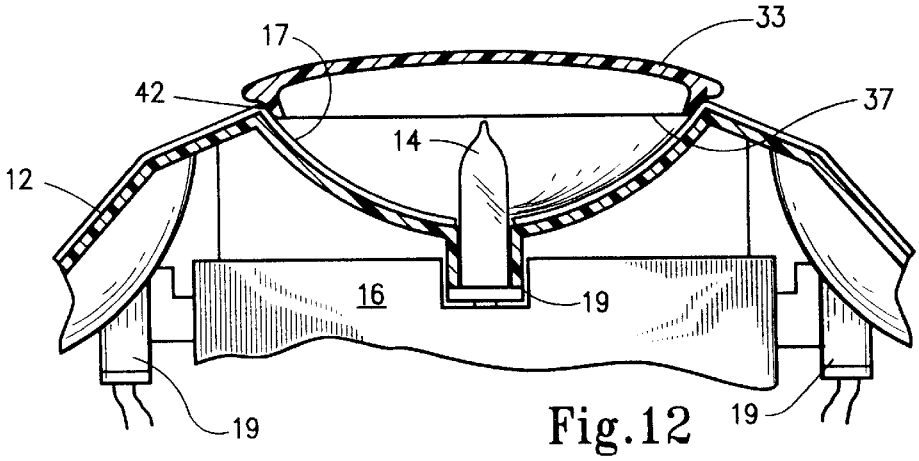
FIG. 12 is a side view in elevation showing a cross section of the small lens cover mounted on the housing concavity.

FIGS. 11 and 12 show a small lens cover 33 sized and configured to fit over a single concavity 17 disposed on the housing 12. The small lens cover 33 has a retention edge 37 to secure the lens to the concavity 17 edge 42 at the exterior surface of the housing 12. The small lens cover 33 is constructed of any colored or non-colored combination of translucent, opaque, or transparent materials. Typical materials would be plastic, glass, paper, and the like. The purpose of the small lens cover 33 is to achieve the unique lighting effects desired from the lighting element 14. These lighting effects could include to adjust the color, lighting diffusion, or lighting intensity as desired for a specific lighting effect. The other concavities could either have no small lens covers 33 or different small lens covers 33 for more alternatives in special lighting effects.

Figure 13:
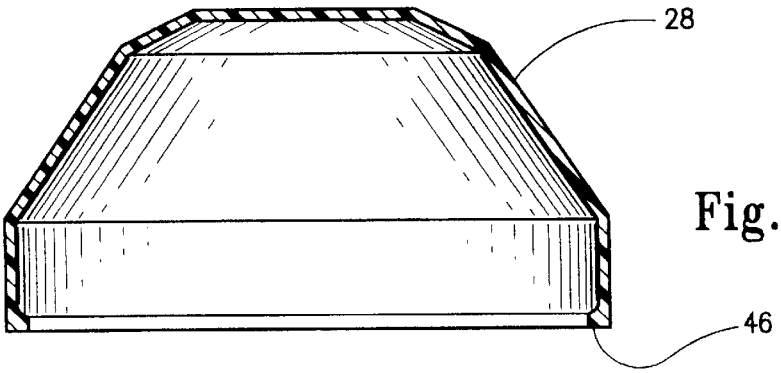
FIG. 13 is a cross section of the large lens cover.
Figure 14:
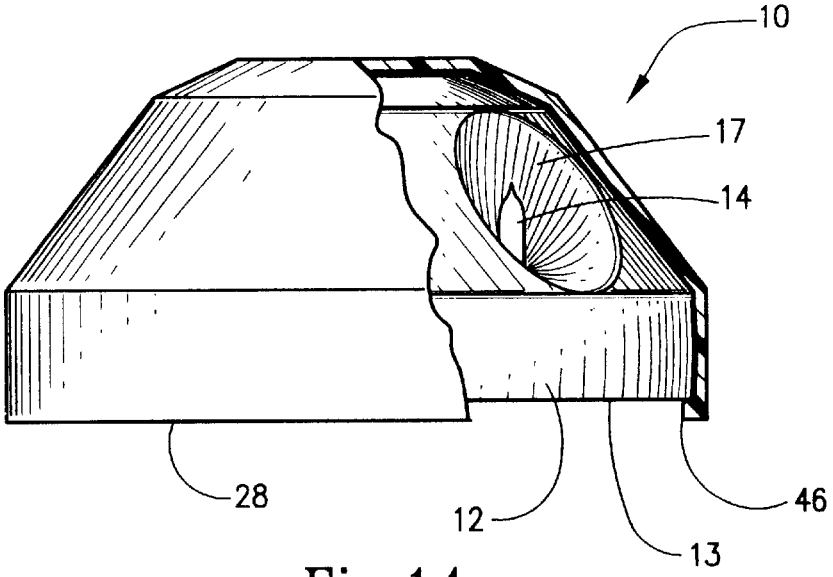
FIG. 14 is a side view in elevation, partially broken away, of the large lens cover installed on the illumination device.

FIGS. 13 and 14 show a large lens cover 28 that is sized and configured to fit over the entire housing 12 of the illumination device 10. The large lens cover 28 has a retention rib 46 to secure the large lens cover to the housing 12. The large lens cover 28 has the effect of covering all of the concavities 17 and lighting elements 14. The large lens cover 28 is constructed of any colored or non-colored combination of translucent, opaque, or transparent materials. Typical materials would be plastic, glass, paper, and the like. The purpose of the large lens cover 28 is to achieve the unique lighting effects desired from the lighting element 14 or lighting elements 14. These lighting effects could include to adjust the lighting color, lighting diffusion, or lighting intensity as desired for a specific lighting effect. In addition, these lighting effects could differ through out the large lens cover 28 structure for more unique lighting effect alternatives.

Figure 15:
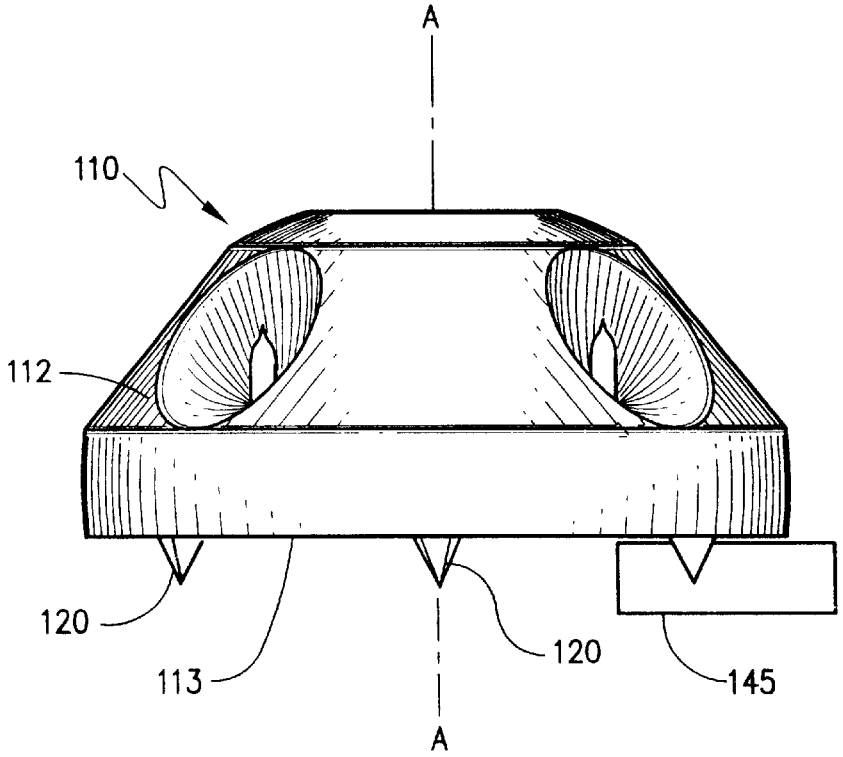
FIG. 15 is a side view in elevation of an alternative illumination device with attachment protrusions extending downward from the bottom portion and connectable to an AC/DC converter.

Turning to FIG. 15, an alternative construction is shown, Here, the housing 112 is shown with attachment protrusions 120 extending from the bottom portion 113 of the housing 112. The purpose of the attachment protrusions 120 is to secure the housing 112 to a soft support surface or a shell by way of piercing the protrusions 120 into the soft support surface if desired for mounting stability of the illumination device 110. The piercing of the support surface is accomplished by pressing the illumination device 110 into the support surface, thus anchoring and securing the illumination device to the support surface. Preferably, at least three attachment protrusions 120 are used, however, a lesser or greater number of protrusions could be used depending upon the softness of the support surface and the mounting stability desired for the illumination device 110. In addition, for a harder support surface, the attachment protrusions 20 can be sized and configured to attach to a mating connector 145 that is affixed to a support surface that can be vertical, angled, inverted, and the like to support the housing 112 from a non-flat support surface. The mating connector 145 can be affixed to a support surface by adhesive, pressure sensitive tape, or any appropriate fastener that one skilled in the art would use for the specific support surface type. One skilled in the art would appreciate that the number of attachment protrusions 120 to each attach to a mating connector 145, can be one or more and is generally dependent upon the nature of the support surface requirements.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiment of the present invention without departing from the inventive concepts contained herein.

We claim:

1. An illumination device adapted to rest on a generally flat support surface and connect to a source of electrical power, comprising:

(a) a housing including a bottom portion adapted to contact the support surface and having an upper dome shaped exterior surface, said housing having at least one concavity formed in the exterior surface such that the concavity has a terminal edge that is contiguous with the exterior surface of said housing, said concavity having an optically reflective concave surface; and (b) an electrical lighting element disposed in the concavity and connectable to a source of electrical power thereby to emit light, said lighting element positioned at a location such that light emitting therefrom is projected from the concavity when said lighting element is connected to the source of electrical power.

2. A device according to claim 1 wherein said housing has a plurality of concavities formed in the exterior surface thereof, each of said concavities having an optically reflective concave surface and including an electrical lighting element disposed therein.

3. A device according to claim 1 wherein said housing has an attachment protrusion extending from said bottom portion.

4. A device according to claim 1 including a light-diffusing lens supported by said housing and positioned to cover said concavity.

5. A device according to claim 1 including a colored lens supported by said housing exterior surface and positioned to cover said concavity.

6. A device according to claim 1 wherein said lighting element can alternate between an off and an on state to simulate a candle's flickering illumination effect.

7. A device according to claim 1 wherein said concavity is defined by a rotated parabola having an edge at the exterior surface of said housing and an interior region bounded by the rotated parabola and a plane containing the edge, and wherein said lighting element is located in the interior region.

8. A device according to claim 1 wherein the exterior surface of said housing and the concave surface of the concavity is completely coated with a common layer of a reflective material.

9. A device according to claim 1 including a sound generating element, said sound generating element disposed in said housing.

10. An illumination device adapted to rest on a generally flat support surface and connect to a source of electrical power, comprising:

(a) a housing including a bottom portion adapted to contact the support surface and having an upper dome shaped exterior surface, said housing having at least one concavity formed in the exterior surface such that the concavity has a terminal edge that is contiguous with the exterior surface of said housing and with said concavity having an optically reflective concave surface;

(b) an electrical lighting element disposed in the concavity and connectable to a source of electrical power thereby to emit light, said lighting element positioned at a location such that light emitting there from is projected from the concavity when said lighting element is connected to the source of electrical power; and (c) means for supplying electrical power to said lighting element.

11. A device according to claim 10 wherein said housing has a plurality of concavities formed in the exterior surface thereof, each of said concavities having an optically reflective concave surface and including a plurality of electrical lighting elements, each of said electrical lighting elements disposed within a respective one of said concavities.

12. A device according to claim 10 including a fiber optic light transmission element having a proximal portion and a distal portion, said proximal portion disposed proximately to said lighting element.

13. A device according to claim 12 including a colored lens sized and configured for use with the proximal portion of said fiber optic light transmission element.

14. A device according to claim 12 wherein said lighting element can alternate between an off and an on state to simulate a candle's flickering illumination effect.

15. A device according to claim 10 wherein said electrical power is supplied by at least one battery disposed within said housing.

16. A device according to claim 10 including an external port disposed on the exterior surface of said housing, said port adapted to receive the electrical power from outside of said housing.

17. A device according to claim 10 including a toggle switch for the electrical power.

18. A decorative system adapted to provide illuminative lighting effects for a festive object to commemorate an event, comprising:

(a) a decorative object including a surrounding sidewall forming an interior, said object having an aperture formed through said sidewall, said aperture sized and configured to display a selected decorative feature when the interior is illuminated;

(b) an illumination device sized and adapted to internally illuminate said object, comprising:

(i) a housing including a bottom portion adapted to contact a support surface and having an upper dome shaped exterior surface, said housing having a concavity formed in the exterior surface, with said concavity having a terminal edge that is contiguous with the upper dome shaped exterior surface;

(ii) an electrical lighting element disposed in the concavity and connectable to the source of electrical power thereby to emit light, said lighting element positioned at a location such that light emitting therefrom is projected from the concavity when said lighting element is connected to a source of electrical power; and (iii) means for supplying electrical power to said lighting element.

19. A decorative system according to claim 18 including an ornamental insert piece for placement into said aperture of said decorative object.

20. A decorative system according to claim 18 wherein said object has a soft shell that has a bottom wall and an upwardly extending surrounding side wall, and wherein said housing includes at least one attachment protrusion extending from said bottom portion, and operative to pierce said shell when the illumination device is pressed into the bottom wall of the shell.

21. A device according to claim 20 including a mating connector that attaches to said attachment protrusion, said mating connector is affixed to the support surface.

22. An illumination device adapted to rest on a generally flat support surface and connect to a source of electrical power, comprising:

(a) a housing including a bottom portion adapted to contact the support surface and having an upper dome-shaped shell having a dome-shaped exterior shell surface, said upper dome-shaped shell having at least one concavity formed integrally therewith such that the concavity has a concave exterior surface which has a terminal edge that is contiguous with the dome-shaped exterior shell surface; and (b) an electrical lighting element disposed in the concavity and connectable to the source of electrical power thereby to emit light, said lighting element positioned at a location such that light emitting therefrom is projected from the concavity when said lighting element is connected to the source of electrical power.

23. An illumination device according to claim 22 wherein the concave exterior surface of the concavity is optically reflective.

24. An illumination device according to claim 22 including a plurality of concavities formed integrally with the upper dome-shaped portion.

25. An illumination device according to claim 24 wherein said concavities a generally distributed equidistantly about said upper dome-shaped portion.

26. An illumination device adapted to rest on a generally flat support surface and connect to a source of electrical power, comprising:

(a) a housing including a bottom portion adapted to contact the support surface and having an upper shell having an upper shell surface, said upper shell having a plurality of concavities formed therein such that the concavity has a concave exterior surface which has a terminal edge that is contiguous with the upper shell surface; and (b) an electrical lighting element disposed in a plurality of the concavities and connectable to the source of electrical power thereby to emit light, each said lighting element positioned at a location such that light emitting therefrom is projected from the concavity when said lighting element is connected to the source of electrical power.

* * * * *